US006681595B1

(12) United States Patent
Thiessen

(10) Patent No.: US 6,681,595 B1
(45) Date of Patent: Jan. 27, 2004

(54) REFRIGERATION CIRCUIT

(75) Inventor: Márcio Roberto Thiessen, Joinville (BR)

(73) Assignee: Empresa Brasileira de Compressores S.A. -Embraco, Joinville (BR)

( * ) Notice: Subject to any disclaimer, the term of this patent is extended or adjusted under 35 U.S.C. 154(b) by 0 days.

(21) Appl. No.: 10/111,529

(22) PCT Filed: Oct. 26, 2000

(86) PCT No.: PCT/BR00/00118

§ 371 (c)(1),
(2), (4) Date: Jul. 8, 2002

(87) PCT Pub. No.: WO01/40719

PCT Pub. Date: Jun. 7, 2001

(30) Foreign Application Priority Data

Dec. 3, 1999 (BR) ..... 9905700

(51) Int. Cl.[7] ..... F25B 39/04; F25B 43/00
(52) U.S. Cl. ..... 62/474; 62/509
(58) Field of Search ..... 62/225, 509, 513, 62/217, 474

(56) References Cited

U.S. PATENT DOCUMENTS

| | | | | | |
|---|---|---|---|---|---|
| 2,181,854 | A | | 11/1939 | Anderson et al. | 62/115 |
| 3,224,217 | A | | 12/1965 | Smith et al. | 62/221 |
| 3,759,057 | A | * | 9/1973 | English et al. | 62/196 |
| 4,026,122 | A | * | 5/1977 | Kuhn et al. | 62/196 |
| 4,091,638 | A | * | 5/1978 | Mitch | 62/470 |
| 4,199,955 | A | * | 4/1980 | Jonsson | 62/79 |
| 4,841,739 | A | | 6/1989 | Wallner | 62/174 |
| 5,062,571 | A | * | 11/1991 | Arno et al. | 236/43 |
| 5,099,655 | A | * | 3/1992 | Arno et al. | 62/225 |
| 5,201,190 | A | * | 4/1993 | Nelson et al. | 62/210 |
| 5,799,499 | A | * | 9/1998 | Yano et al. | 62/225 |

FOREIGN PATENT DOCUMENTS

| | | | |
|---|---|---|---|
| DE | 2800 210 | 8/1978 | F25D/29/00 |
| DE | 4207 859 | 9/1993 | F25B/45/00 |
| DE | 198 43 484 | 3/2000 | F25B/39/02 |
| EP | 0480 330 | 4/1992 | F25B/45/00 |
| EP | 0685 694 | 4/1995 | F25B/43/00 |
| EP | 0703 421 | 3/1996 | F25D/11/02 |
| GB | 2122734 | 1/1984 | F25B/41/00 |
| JP | 99/02928 | 1/1999 | F25B/1/00 |

* cited by examiner

*Primary Examiner*—Melvin Jones
(74) *Attorney, Agent, or Firm*—Darby & Darby

(57) ABSTRACT

An improvement in a refrigeration circuit comprising a hermetic chamber (10), which is maintained in fluid communication with the refrigeration circuit, immediately downstream at least one of the parts defined by a condenser (5) and by a hermetic compressor (1), and which is dimensioned to store, in conditions of long stops of the hermetic compressor (1) and of a start thereof, a substantial volume of refrigerant fluid, said hermetic chamber (10) returning to the refrigeration circuit substantially all the refrigerant fluid stored therein, after said conditions have ended.

15 Claims, 2 Drawing Sheets

REFRIGERATION CIRCUIT

FIELD OF THE INVENTION

The present invention refers to a construction of a refrigeration circuit for refrigeration systems having a hermetic compressor and a condenser, of the type used in small refrigeration appliances of domestic use, such as refrigerators and freezers.

BACKGROUND OF THE INVENTION

In the conventional refrigeration systems, the refrigeration circuit comprises, essentially and sequentially, a hermetic compressor, a condenser, a pressure reducing element, such as a capillary tube, an evaporator and a return line.

In this circuit, the hermetic compressor draws the low pressure refrigerant gas and pumps it to the condenser as a high pressure hot gas. Upon passing through the condenser, said gas is liquefied, losing heat to the environment.

From the condenser, the refrigerant liquid is led to the evaporator, after having its pressure reduced in the capillary tube, where it reaches its gaseous state again, before being drawn by the compressor, starting a new cycle.

In domestic or commercial refrigeration systems, there are used air cooled condensers, which are designed to dissipate the heat transferred to the refrigerant fluid in the evaporator and during compression in the compressor, as well as to condense this refrigerant fluid, making it become liquid.

In small refrigeration systems, the condenser used may have forced or natural ventilation (static refrigeration). In these systems, in which said condenser has a very small volume, at the start of the compressor after a long stop period, all gas load is pumped to the condenser, making the condensation pressure increase and, in many cases, exceed acceptable values. This occurs because, most of the time, the volume of the condensers does not take up the volume of the gas load or, when it does so, the heat exchange area is diminished. During start, the refrigerant fluid contained in the condenser is in the liquid form.

In these situations, there occurs an accumulation of liquid in the condenser, from an outlet portion thereof, which tends to fill up its whole volume, gradually reducing the effective condensation area of the condenser. The condensation pressure may increase to such values as to impair the bearings and/or valves of the compressor and also make the compressor stop working.

In order to reduce damages, these systems require, either a larger condenser, which is usually infeasible due to the dimensions of the product to which it is applied, or the use of very strong motors, increasing the cost of the system, considering that these situations occur few times, for example when the equipment is turned off for cleaning or transportation.

DISCLOSURE OF THE INVENTION

Thus, it is an object of the present invention to provide an improvement in a refrigeration circuit for a refrigeration system which, with reduced cost and easy construction, may minimize the presence of liquids in the condenser, soon after the start of the compressor which has had a long stop period, maintaining constant the useful condensation area of the condenser, without requiring stronger motors.

These and other objectives are achieved by an improvement in a refrigeration circuit, including: a hermetic compressor having a shell; and a condenser having an inlet connected to a discharge outlet of the compressor and an outlet, and comprising a hermetic chamber maintained in fluid communication with the refrigeration circuit, immediately downstream at least one of the parts defined by the condenser and by the compressor, and which is dimensioned to store, in conditions of long stops of the compressor and of a start thereof, a substantial volume of refrigerant fluid, said hermetic chamber returning to the refrigeration circuit substantially all the refrigerant fluid stored therein, after said conditions have ended.

BRIEF DESCRIPTION OF THE DRAWINGS

The invention will be described below, with reference to the attached drawings, in which.

BEST MODE OF CARRYING OUT THE INVENTION

Figure 1:
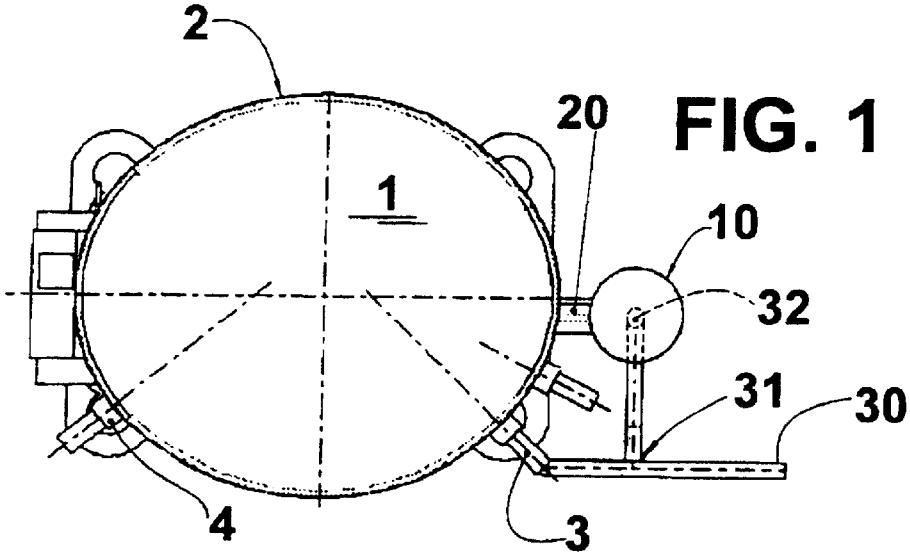
FIG. 1 illustrates, schematically, part of a refrigeration circuit for a refrigeration appliance, such as a refrigerator, constructed according to an embodiment of the present invention.

The improvement of the present invention will be described in relation to a refrigeration circuit including a hermetic compressor 1 having a shell 2 with a discharge outlet 3 and a suction inlet 4; a condenser 5 having a gaseous fluid inlet 6, which is operatively connected to the discharge outlet 3 of the hermetic compressor 1, and a condensed fluid outlet 7 connected to a non-illustrated capillary tube, for example, by means of a drying filter 8. The refrigeration circuit further includes, though not illustrated, an evaporator having a condensed fluid inlet, which is operatively connected to the capillary tube, and a gas outlet in fluid communication with the suction inlet 4 of the hermetic compressor 1.

In this circuit, low pressure refrigerant gas is drawn by the hermetic compressor 1 and is pumped, as a high pressure hot gas, to the condenser 5, where said gas is liquefied, losing heat to the environment. The condensation occurs by heat exchange between the condenser 5 and its external environment.

The passage of the liquefied fluid through the capillary tube reduces the pressure of the refrigerant fluid, before it reaches the evaporator, wherefrom, after changing heat with the internal environment of the refrigerator and in the form of a low pressure gas, it is drawn by the hermetic compressor 1, starting a new cycle.

According to the present invention, the improvement in a refrigeration circuit of the present invention comprises a hermetic chamber 10 maintained in fluid communication with the refrigeration circuit, immediately downstream at least one of the parts defined by the condenser 5 and by the hermetic compressor 1 and which is dimensioned to store, in conditions of long stops of the compressor followed and of a start thereof, a substantial volume of refrigerant fluid, said hermetic chamber 10 returning to the refrigeration circuit substantially all the refrigerant fluid stored therein, after the end of each long stop condition of the hermetic compressor 1 and after the initial operational period thereof has passed.

The hermetic chamber 10 is dimensioned to take up all the refrigerant fluid, in the liquid state, of the refrigeration circuit, at the highest room temperature where is located the refrigeration appliance to which this refrigeration circuit is coupled.

According to the present invention, the hermetic chamber 10 has a tubular body 11, usually cylindrical, provided with an inlet 12 and an outlet 13 of refrigerant fluid, said inlet 12 being provided at an upper portion of the tubular body 11.

In the embodiment illustrated in FIG. 1, the hermetic chamber 10 has its inlet 12 coupled to and in fluid communication with the outlet 7 of the condenser 5, and its outlet 13 in fluid communication with the fluid restricting means of the refrigeration circuit, particularly through the drying filter 8.

Figure 2:
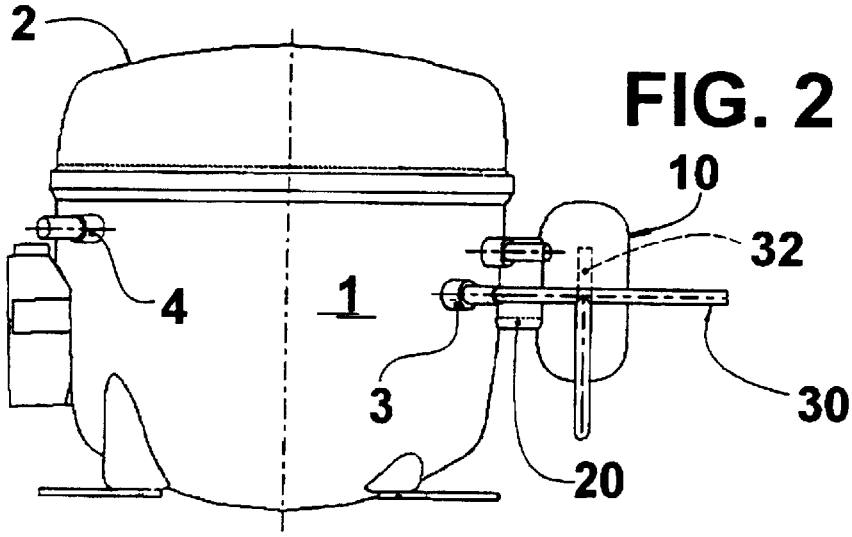
FIG. 2 illustrates, schematically, as in FIG. 1, part of a refrigeration circuit for a refrigeration appliance, such as a refrigerator, constructed according to another embodiment of the present invention.

In this construction, the refrigerant fluid in liquid state leaving the condenser 5 is received and accumulated in the hermetic chamber 10, which acts as a reservoir of said liquid, which will be conducted to the fluid restricting means. In a variant form of this construction, as illustrated in FIG. 2, the hermetic chamber 10 is defined in the body of the drying filter 8.

In the illustrated constructions of FIGS. 3 and 4, the hermetic chamber 10 is affixed adjacent to and downstream the hermetic compressor 1, through a heat conductive connection 20, which is for example metallic, in order to be heated by the heat of the compressor, upon operation thereof, as described below.

In these constructions, the fluid communication between the hermetic chamber 10 and the refrigeration circuit occurs through a supply duct 30, provided in a circuit parallel to said refrigeration circuit and which defines, as a function of the direction of displacement of the refrigerant fluid therethrough, the inlet and the outlet of the hermetic chamber 10 of this construction.

Figure 5:
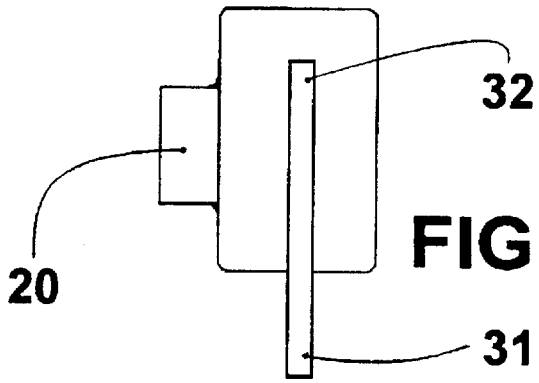
FIG. 5 illustrates, schematically and in a longitudinal cross-sectional view, the hermetic chamber of the present invention.

The supply duct 30 has a determined extension, which is provided with an external end 31, opened to the refrigeration circuit, and an internal end 32, which is positioned inside the hermetic chamber 10 (FIG. 5) above a maximum filling limit of said hermetic chamber when filled with the refrigerant fluid in the liquid state.

In the illustrated solution, the supply duct 30 has part of its extension, adjacent to the respective internal end 32, introduced into the hermetic chamber 10 at a lower portion of the latter and so that said internal end 32 be positioned inside said hermetic chamber 10 above the maximum filling limit of said hermetic chamber, with the refrigerant fluid in the liquid state.

Figure 3:
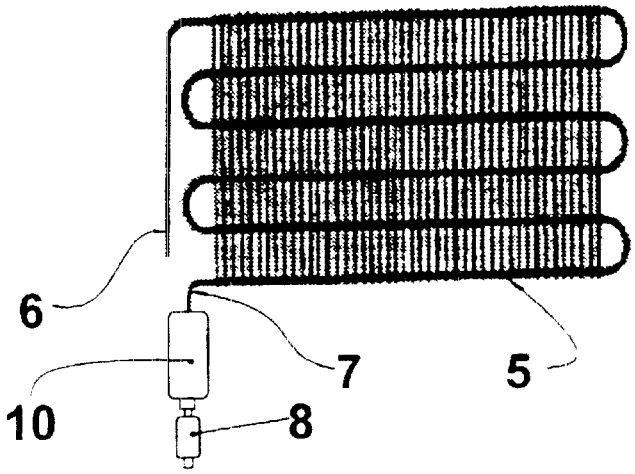
FIG. 3 illustrates, schematically and in an upper view, a hermetic compressor of the refrigeration circuit to which is mounted the hermetic chamber of the present invention.
Figure 4:
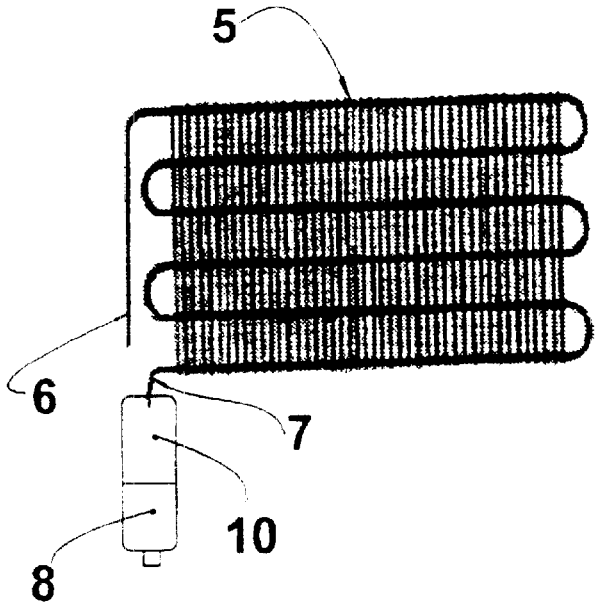
FIG. 4 illustrates, schematically and in a lateral view, the construction illustrated in FIG. 3.

In the solution illustrated in FIGS. 3 and 4, the refrigerant fluid admitted into the hermetic chamber 10 and coming out from the discharge tube is in the gaseous state, is condensed inside said discharge tube and remains deposited therein, until the operation of said hermetic compressor 1 increases the temperature, which will be transmitted, through the heat conductive connection 20, to the hermetic chamber 10, heating said refrigerant fluid in the liquid state, until it reaches a gaseous form and, through the internal end 32 of said hermetic chamber 10, it flows through the supply duct 30 towards the refrigeration circuit, being then conducted, with the gas flow pumped by the hermetic compressor 1, to the condenser 5.

According to the present invention, the hermetic chamber 10 further has a drain, not illustrated, which allows to occasionally remove from the inside of said hermetic chamber the impurities carried by the refrigerant fluid.

What is claimed is:

1. An improvement in a refrigeration circuit, including: a hermetic compressor (1) having a shell (2); and a condenser (5) having an inlet (6) connected to a discharge outlet of the hermetic compressor (1) and an outlet (7), characterized in that it comprises a hermetic chamber (10), which is maintained in fluid communication with the refrigeration circuit, immediately downstream at least one of the parts defined by the condenser (5) and by the hermetic compressor (1), and which is dimensioned to store, in conditions of long stops of the hermetic compressor (1) and of a start thereof, a substantial volume of refrigerant fluid, said hermetic chamber (10) returning to the refrigeration circuit substantially all the refrigerant fluid stored therein, after said conditions have ended.

2. The refrigeration circuit of claim 1, characterized in that the hermetic chamber (10) is dimensioned to receive all the refrigerant fluid in the liquid state.

3. The refrigeration circuit of claim 1, characterized in that the hermetic chamber (10) is constructed in order to prevent the refrigerant fluid in the liquid state from returning to the condenser(5), even when said hermetic chamber (10) stores all the refrigerant fluid, in the liquid state, of the refrigeration circuit.

4. The refrigeration circuit of claim 2, characterized in that the hermetic chamber (10) has a tubular body (11) in which is provided an inlet (12) and an outlet (13) of refrigerant fluid, said inlet (12) being provided in an upper portion of the tubular body (11) thereof.

5. The refrigeration circuit of claim 3, characterized in that the hermetic chamber (10) has its inlet (11) coupled to and in fluid communication with an outlet (7) of the condenser (5), and its outlet (13) in fluid communication with a fluid restricting means of the refrigerant circuit.

6. The refrigeration circuit of claim 5, characterized in that the outlet (13) of the hermetic chamber (10) is maintained in constant fluid communication with the inlet of a drying filter (8) provided in the refrigeration circuit upstream the fluid restricting means.

7. The refrigeration circuit of claim 5, characterized in that the hermetic chamber (10) is defined in the body of a drying filter (80) provided in the refrigeration circuit upstream the fluid restricting means.

8. The refrigeration circuit of claim 4, characterized in that the hermetic chamber (10) is provided downstream the hermetic compressor (1), through a respective supply duct (30) provided in a circuit parallel to said refrigeration circuit and which defines, simultaneously, the inlet and the outlet of the hermetic chamber (10).

9. The refrigeration circuit of claim 8, characterized in that the inlet (12) of the hermetic chamber (10) is provided above a maximum filling limit of said hermetic chamber (10) with the refrigerant fluid in the liquid state.

10. The refrigeration circuit of claim 9, characterized in that the hermetic chamber (10) is affixed to the shell of the hermetic compressor (1) through a heat conductive connection (20), in order to be heated by the heat of the hermetic compressor (1) upon operation thereof.

11. The refrigeration circuit of claim 10, characterized in that the supply duct (30) has a determined extension with an external end (31) opened to the refrigeration circuit, and an internal end (32), internal to the hermetic chamber (10), said supply duct (30) having part of its extension, adjacent to the respective internal end (32), introduced into the hermetic chamber (10) at a lower portion of the latter and so that said internal end (32) be positioned inside said hermetic chamber (10) above the maximum filling limit of said hermetic chamber (10) with refrigerant fluid in the liquid state.

12. The refrigeration circuit of claim 1, characterized in that the hermetic chamber (10) is provided with a drain for removing the impurities carried by the refrigerant fluid.

13. An improvement in a refrigeration circuit, comprising:

a hermetic compressor having a shell;

a condenser comprising:

an inlet connected to a discharge outlet of the hermetic compressor; and an outlet comprising a hermetic chamber, which is maintained in fluid communication with the refrigeration circuit, immediately downstream at least one of the parts defined by the condenser and by the hermetic compressor, and which is dimensioned to store, in conditions of long stops of the hermetic compressor and of a start thereof, a substantial volume of refrigerant fluid;

the hermetic chamber returning to the refrigeration circuit substantially all the refrigerant fluid stored therein, after the conditions have ended, wherein the hermetic chamber is dimensioned to receive all the refrigerant fluid in the liquid state;

the hermetic chamber having a tubular body in which is provided an inlet and an outlet of refrigerant fluid, the inlet being provided in an upper portion of the tubular body;

the hermetic chamber is provided downstream of the hermetic compressor, through a respective supply duct provided in a circuit parallel to said refrigeration circuit and which defines, simultaneously, the inlet and the outlet of the hermetic chamber; and the inlet of the hermetic chamber is provided above a maximum filling limit of the hermetic chamber with the refrigerant fluid in the liquid state.

14. The refrigeration circuit of claim 13, wherein the hermetic chamber is affixed to the shell of the hermetic compressor through a heat conductive connection, in order to be heated by the heat of the hermetic compressor upon operation thereof.

15. The refrigeration circuit of claim 14, wherein the supply duct has a determined extension with an external end opened to the refrigeration circuit, and an internal end, internal to the hermetic chamber, said supply duct having part of its extension, adjacent to the respective internal end, introduced into the hermetic chamber at a lower portion of the latter and so that said internal end be positioned inside said hermetic chamber above the maximum filling limit of said hermetic chamber with refrigerant fluid in the liquid state.

* * * * *